United States Patent [19]

Fridlund et al.

[11] 4,055,010

[45] Oct. 25, 1977

[54] MICRO FILM STORING DEVICE

[76] Inventors: Gösta Fridlund, Boul.Louis Mettewie 9-11 Apt. 16B, 1080 Brussels, Belgium; Jan Jiveman, Stravagen No. 2, Jarfanna-Jakobsberg, Sweden

[21] Appl. No.: 450,408

[22] Filed: Mar. 12, 1974

[51] Int. Cl.[2] ..... G09F 1/10

[52] U.S. Cl. ..... 40/124; 150/39

[58] Field of Search ..... 229/72; 150/39; 40/104.03, 124.2, 124.4, 124

[56] References Cited

U.S. PATENT DOCUMENTS

| | | | |
|---|---|---|---|
| 837,481 | 12/1906 | Leuthesser | 40/124.4 |
| 1,047,840 | 12/1912 | Reynolds | 40/124.2 |
| 1,980,241 | 11/1934 | Wilson et al. | 229/72 X |
| 2,218,305 | 10/1940 | Ainsworth | 40/124.4 X |
| 2,226,976 | 12/1940 | Leaming | 150/39 |
| 2,361,141 | 10/1944 | Woolf et al. | 40/104.03 X |
| 2,959,879 | 11/1960 | Mazur | 40/124.4 X |
| 3,073,050 | 1/1963 | Dubois | 40/124.4 |
| 3,759,305 | 9/1973 | McIntyre | 150/39 |
| 3,850,083 | 11/1974 | Falcon | 229/72 X |

FOREIGN PATENT DOCUMENTS

| | | | |
|---|---|---|---|
| 33,389 | 1964 | Finland | 40/104.03 |
| 810,870 | 8/1951 | Germany | 40/104.03 |

*Primary Examiner*—Stephen P. Garbe

[57] ABSTRACT

A storage device for filamentous material formed by a base sheet and a cover sheet. The base sheet has a vertical row of peaked or arched slots and the cover sheet a corresponding number of horizontal slots. The slots in the base sheet define parallel ribbons and the slots in the cover sheet define horizontal ribbons. The cover sheet is secured to the base sheet by spot-welding. The peaks of the base sheet ribbons are welded to the horizontal ribbons and the sheets are welded at the sides to form thereby a partition defining intermediate pockets for the filamentous material.

3 Claims, 5 Drawing Figures

FIG. 4
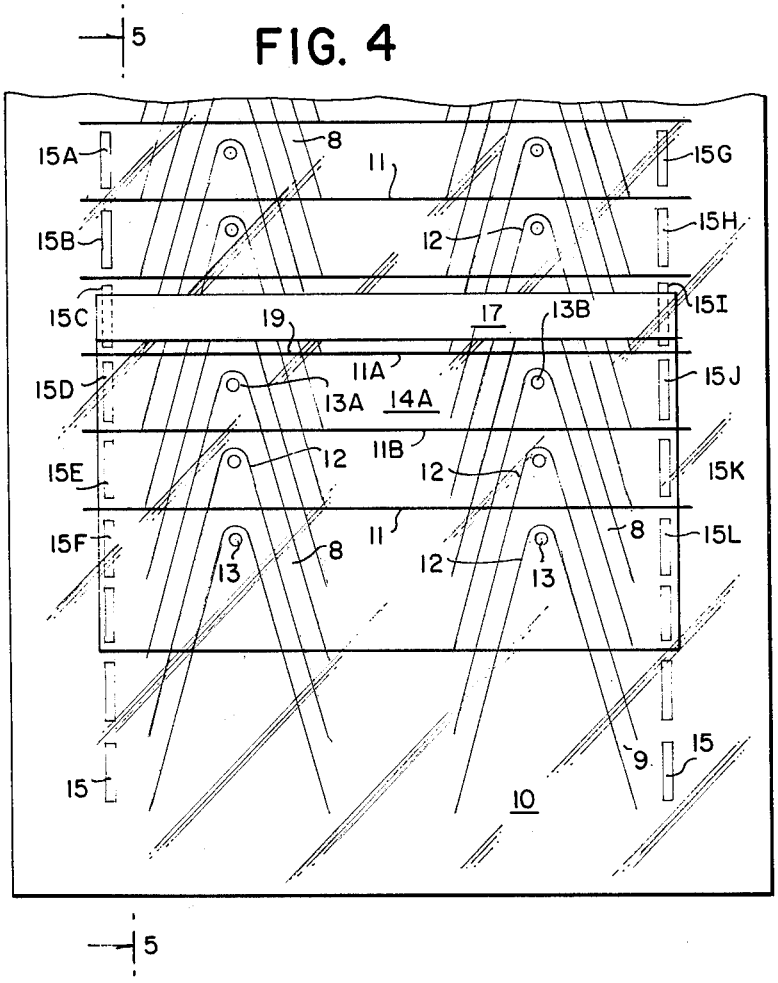
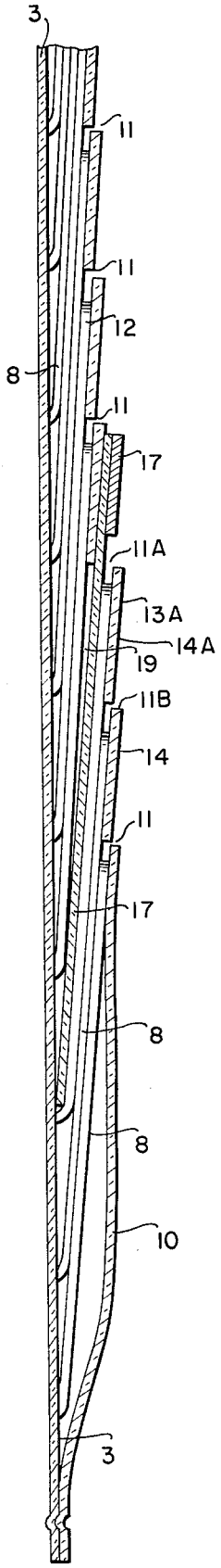
FIG. 5

MICRO FILM STORING DEVICE

The present invention is generally related to folder arrangements and especially to folders of the type that is divided in partitions for keeping thin leave-shaped devices, such as micro film and film negatives.

In connection with the increased use of micro-photographing for information storing, record keeping, etc., a need has arisen for suitable storage means for such films. Films are normally kept in pockets or partitions of various kinds depending on the type and size of the negatives. These pockets or partitions are often arranged on larger leaves, which are stored in suitable boxes or folders.

A commonly known problem in connection with stores and archives is that the available space is filled very quickly due to the large amount of material. It is therefore always a need to find new and less consuming storage units and the desire is to decrease the space-need for these units in relation to the stored material.

The object of the present invention is to create a simple and practical solution of this problem and to suggest a new type of combined storage pocket with partitions suitable for insertion in a cover and the specific characteristics of the invention are stated in the following claims.

The invention will now be more closely described in connection with the accompanying drawings, which illustrate the principle of an embodiment thereof.

FIG. 4 illustrates a fragment of the complete storage unit formed in FIG. 3 with a film in the arched pocket; and FIG. 5 shows a cross-section taken on line A—A of FIG. 4.

Figure 1:
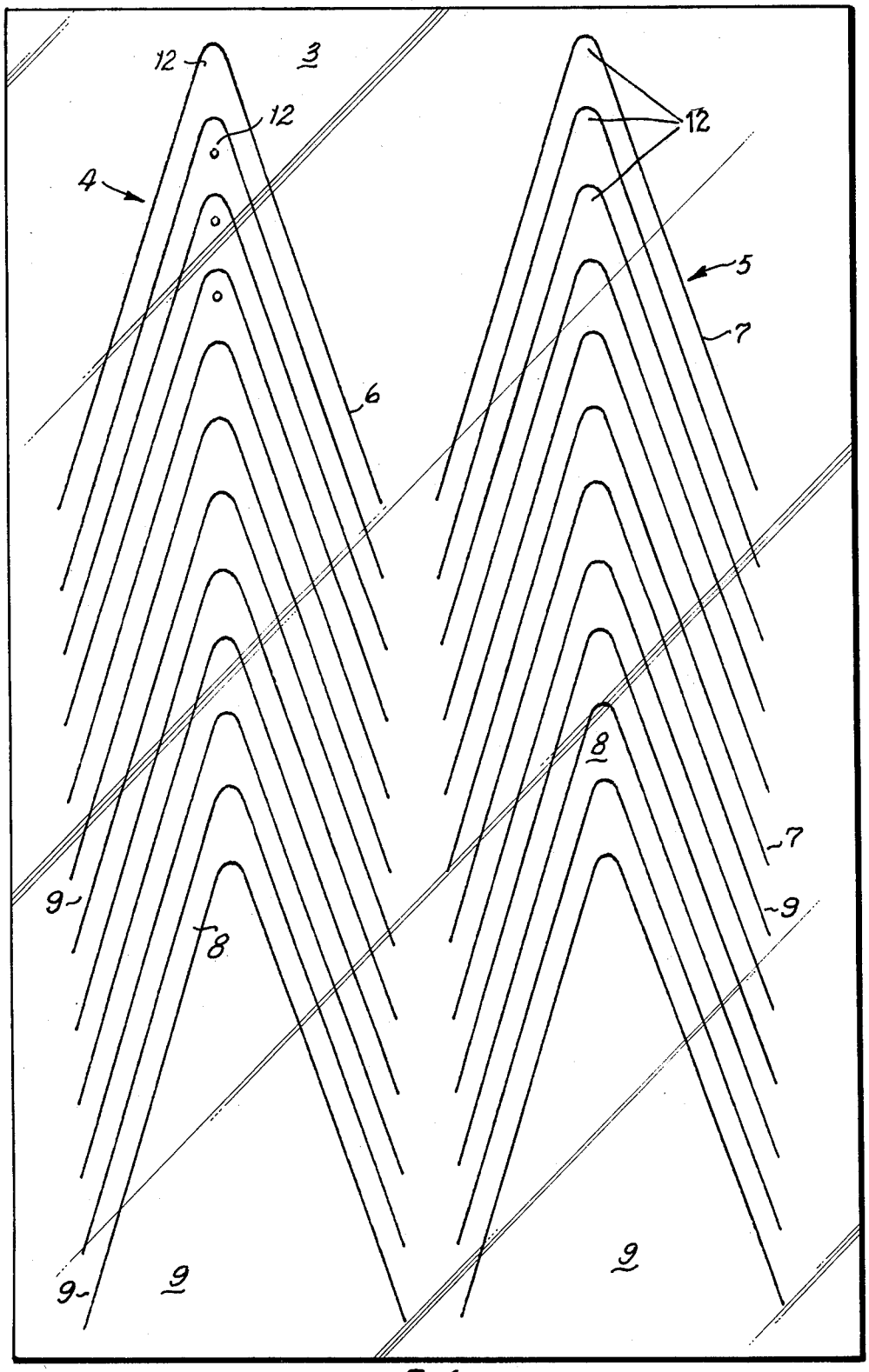
FIG. 1 illustrates the principle of a sheet forming the base of a combined storage unit.

FIG. 1 shows the contours of a base sheet. This sheet 3, which in the present case is made of a rather stiff PVC-material, is provided with two parallel rows of slots 4, 5, which are made by the aid of a suitable punch-tool, the edges 4, 5 of which form an upside down V. By displacing the tool relative to the sheet rows in uniform slots are obtained. Within the rows the material is thus divided in narrow interconnected ribbons 8 forming upside down V:s. These ribbons are connected at 9 to the base sheet at the lower ends and will form the main parts of the partitions therein, when the top of the V-shaped ribbons is bent out from the base plane of sheet 3.

As mentioned above there are in this manner created as many partitions from the base material as there are through-punchings, which gives a considerable number of useable partitions at a rather close punch density. It should be observed that this is achieved according to the present invention by only one single layer or sheet 3 of base material at each point thus giving a minimum thickness. The punched V-shaped ribbon-parts are marked 8 in FIG. 1.

Figure 2:
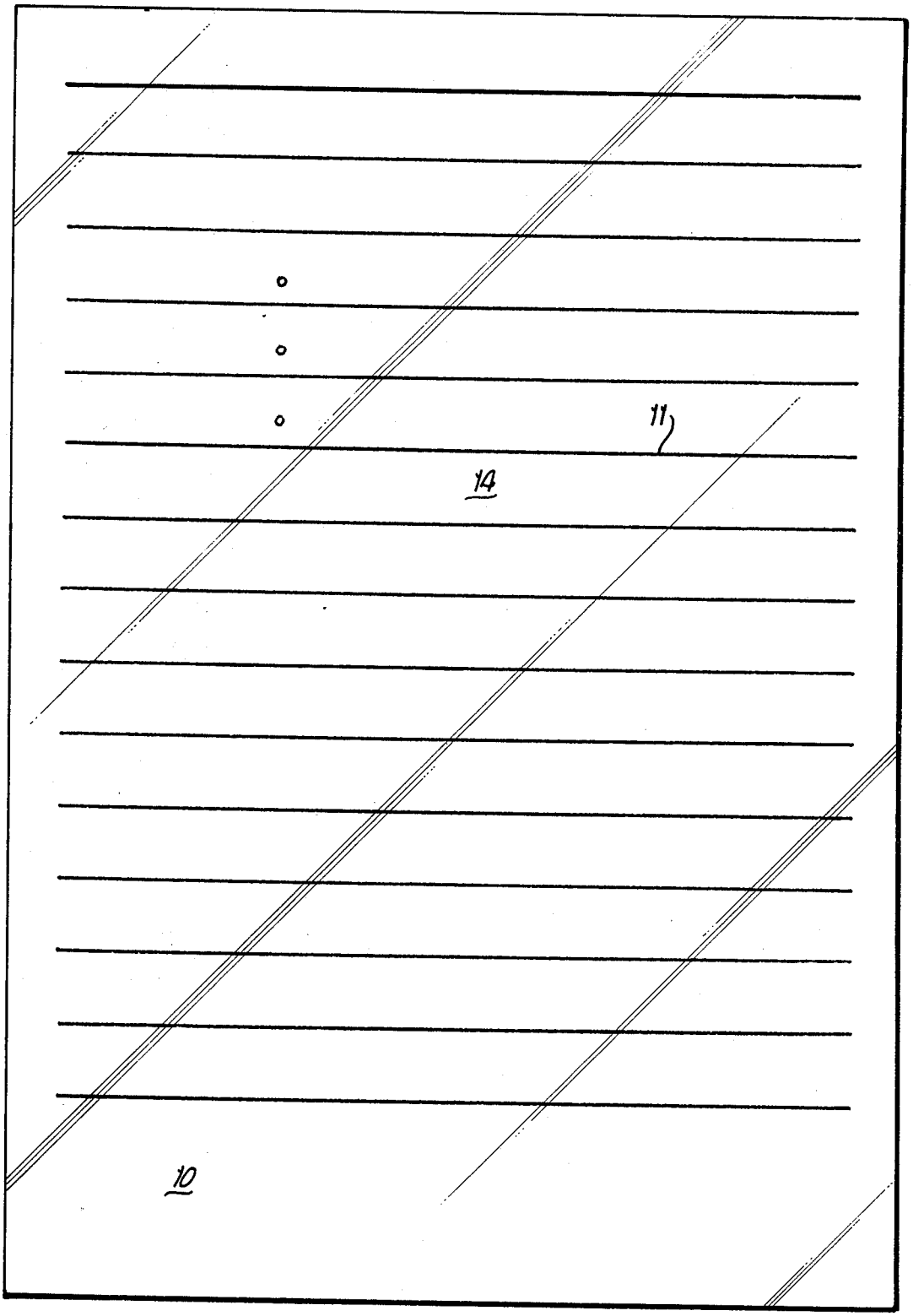
FIG. 2 illustrates the principle of a cover sheet which is to be placed over the base sheet according to FIG. 1 and fixed thereon according to predetermined principles.

The base material alone creates, however, no complete functioning unit but has to be completed by a cover layer according to FIG. 2. This cover sheet 10 has the same dimensions as the base sheet 3 and is provided with linear horizontal through-punchings 11, the length and interseparation of which are selected so that a number of ribbons 14 are created which, when combining the base and the cover sheets, each one covers one pair of ribbon peaks 12 in the base material. The ribbons 8 of the cover sheet 3 and the base ribbon peaks 12 are then point-welded together at 13 (FIG. 3) thus creating complete storage partitions or pockets, the upper limits of which are marked by the horizontal ribbons of the cover sheet. Vertical weldings at 15 limit the width of the partitions and the cover ribbons.

The specification is only intended to clarify the principle of the structure of the proposed storage unit. In practice it is suitable to use material of double width, where it by double-folding is possible to create a storage unit with partitions on both front and back sides.

This unit may then be provided with a stiffening and punching at one longitudinal side for insertion as a sheet in a collecting cover. The other longitudinal side may be provided with tags for grouping the sheets.

Figure 3:
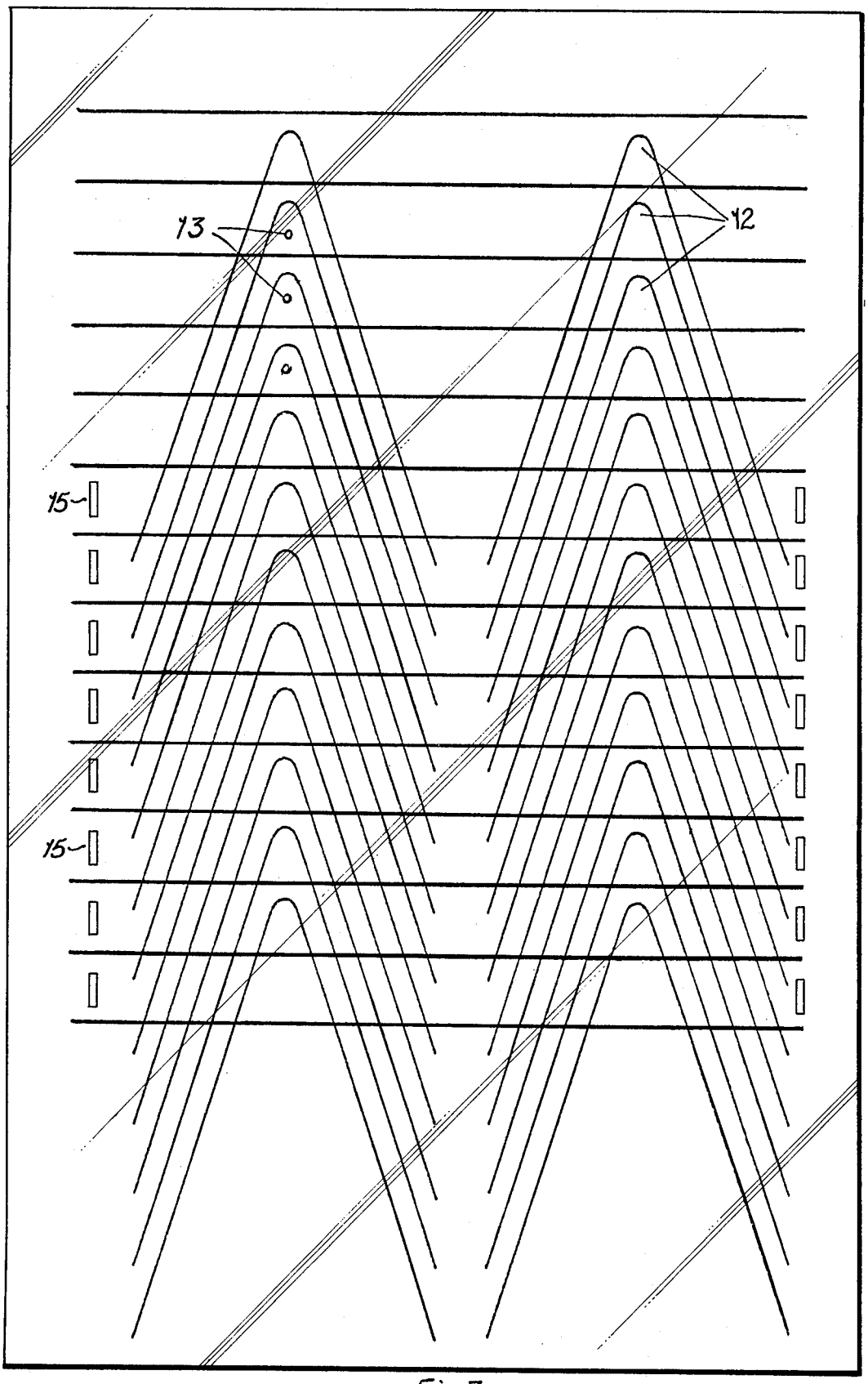
FIG. 3 illustrates the two sheets combined, the junctions there-between being marked in order to show the principle of interconnection.

FIG. 3 shows the combination of the base and the cover sheets where 13 illustrates the welding point. The Figure shows the peak-shaped parts of the base and the ribbons of the cover sheets in relation to each other.

The invention is generally described in the specification and a practical example is given. However, it is obvious that the details related to selection of dimensions, material and completions for special purposes can be varied in different ways without departing from the basic inventive idea. As to the selection of material it is to be noted that it is important in connection with the use of the invention for keeping films that the material does not affect the film in a bad way. Due to this a preferred material in this connection is a stiff PVC material with low percentage of plasticizer, whereby the inserted film will be protected against migration from the plastic. Other materials could also be considered, e.g. fully or partly transparent. This is however not essential for the basic idea of the invention.

We claim:

1. A storage device having pockets for receiving filamentous material, said device being formed by a base sheet and a cover sheet, said base sheet having formed therein at least one vertical row of arched cuts, said cover sheet having formed therein spaced horizontal cuts corresponding in number to each arched cut formed in said base sheet, said cover sheet being superposed over said base sheet and being secured thereto at at least one point adjacent each peak of each of said arched cuts and between said horizontal cuts of said cover sheet to form pockets to receive filamentous material suitable for storage, and said device further including vertical welds between said base sheet and said superposed sheet and laterally of said arched cuts to form lateral boundaries to said formed pockets.

2. A storage device having pockets for receiving thin filamentous articles, said device being formed by a base sheet and a cover sheet, said base sheet having formed therein at least one vertical row of peaked cuts to form peaked ribbons, said cover sheet having formed therein spaced horizontal cuts corresponding in number to said peaked cuts formed in said base sheet, said cover sheet being superposed over said base sheet and being secured thereto at at least one point along each of said peaked ribbons and between said horizontal cuts of said cover sheet, and being further secured by vertically disposed weldings adjacent the ends of said horizontal cuts and laterally of said peaked cuts to form pockets to receive said filamentous articles for storage.

3. A storage device having pockets for receiving filamentous material, said device being formed by a base sheet and a cover sheet, said base sheet having formed therein at least one vertical row of arched cuts, said cover sheet having formed therein spaced horizontal cuts corresponding to said arched cuts formed in said base sheet, said cover sheet being superposed over said base sheet and being secured thereto at at least one point adjacent the peak of each of said arched cuts and between said horizontal cuts of said cover sheet, and said base sheet and said cover sheet being further secured to each other vertically adjacent the ends of said arched cuts to form lateral boundaries to pockets formed between said horizontal cuts and said arched cuts.

* * * * *

UNITED STATES PATENT OFFICE

CERTIFICATE OF CORRECTION

PATENT NO. : 4,055,010
DATED : October 25, 1977
INVENTOR(S) : Gosta Fridlund and Jan Jiveman It is certified that error appears in the above-identified patent and that said Letters Patent are hereby corrected as shown below:

Column 1, line 49, change "4,5" to --6,7--.

Column 1, line 50, change "in" to --of--.

Column 1, line 65, after "The" insert --cut or-- and after "punched" insert --arched or--.

Column 2, line 3, after "horizontal" insert --cuts or--.

Column 2, line 8, change "8" to --14--.

Column 2, line 25, before "peaked-shaped" insert --arched or--,and after "parts" insert --8--.

Column 2, between lines 26 and 27 insert the following:

--The sheets as illustrated in Figures 1 and 2, respectively, when united as in Figure 3 by the weldings 13 and 15 define pockets in which a film or filamentous material 17 may be inserted. As illustrated in Figure 4 the film 17 is in the pocket 19 which is formed by the horizontal linear punching 11a

UNITED STATES PATENT OFFICE

CERTIFICATE OF CORRECTION

PATENT NO. : 4,055,010
DATED : October 25, 1977
INVENTOR(S) : Gosta Fridlund and Jan Jiveman It is certified that error appears in the above-identified patent and that said Letters Patent are hereby corrected as shown below:

and welded at 13a and 13b to the ribbon 14a defined by the linear horizontal punchings 11a and 11b. The lateral boundary of the pocket 19 is formed by the vertical weldings 15a through 15f on the left side and 15g through 15L on the right side. The next adjacent pocket is, of course, formed at the linear horizontal punching 11b. As many pockets will be formed as there are combined ribbon peaks 12 welded to ribbons 8.--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*